United States Patent [19]

Schweers

[11] 4,078,491

[45] Mar. 14, 1978

[54] PORTABLE CREDIT CARD IMPRINTER

[76] Inventor: Karl D. Schweers, 302 E. Highland Ave., Atlantic Highlands, N.J. 07716

[21] Appl. No.: 652,108

[22] Filed: Jan. 26, 1976

[51] Int. Cl.[2] ..... B41F 3/20

[52] U.S. Cl. ..... 101/269

[58] Field of Search ..... 101/269–274, 101/45, 56

[56] References Cited

U.S. PATENT DOCUMENTS

| | | | |
|---|---|---|---|
| 3,260,199 | 7/1966 | Huntley et al. | 101/269 |
| 3,572,241 | 3/1971 | Waterman | 101/269 |
| 3,596,596 | 8/1971 | Chillingworth | 101/269 |
| 3,704,668 | 12/1972 | St. Onge et al. | 101/269 |
| 3,705,548 | 12/1972 | Waterman | 101/269 |
| 3,763,777 | 10/1973 | Brown | 101/269 |
| 3,814,015 | 6/1974 | Ozaki et al. | 101/269 |
| 3,830,155 | 8/1974 | Pinedo | 101/269 |
| 3,838,641 | 10/1974 | McInnis | 101/269 |

*Primary Examiner*—Edward M. Coven

*Attorney, Agent, or Firm*—Mel K. Silverman; David A. Jackson

[57] ABSTRACT

A portable imprinter for transferring indicia from a printing plate to a document comprising a generally rectangular base adapted to support the document in printing disposition over the plate, a frame mounted on the base, a pair of longitudinally extended slots located on opposite sides of the base at its junction with the frame for insertion of the printing plate and the document, and an imprinting roller assembly comprising a generally rectangular reciprocable carriage movably mounted within said frame, a printing roller supported within a U-shaped bracket, said bracket pivotally retained within said carriage on the side thereof juxtaposed to said base, and a rectangular cover mounted on said carriage on the side thereof opposite said bracket, wherein said bracket is under spring bias, placing said roller in constant contact with said base. During the printing cycle, the bracket pivots into rigid abutment with the cover to provide printing tension to the roller. During the return cycle, the bracket is freely cradled by the carriage, and the roller passes harmlessly along the printed document, thereby avoiding over-printing or other damage thereto.

9 Claims, 6 Drawing Figures

PORTABLE CREDIT CARD IMPRINTER

BACKGROUND OF THE INVENTION

The present invention relates to portable imprinters and, in particular, to such imprinters useful for recording credit card sales transactions.

The pervasive presence of credit extension in modern day business transactions through the vehicle of the credit card has resulted in the institution of credit card transactions in almost every facet of commerce. As a direct result of this development, a need has arisen for an efficient and durable imprinting mechanism which may be employed in a wide variety of transactional situations not heretofore contemplated and thereby not capable of accommodation by conventional imprinters. Thus, such factors as size, cost, ease of operation and mechanical reliability of conventional imprinters has severely curtailed the growth of their employment in such areas as door-to-door sales and other transactions which commend themselves to a portable imprinter unit.

While there are various portable importable imprinters which have been developed and have been known in the art, their use is quite limited as they suffer from some of the same defects noted with regard to imprinters generally. That is, the imprinters are often complex and expensive, and likewise are often prepared from materials which tend to corrode or otherwise break down after prolonged usage. Many of the imprinters are incapable of providing a uniform print density regardless of the thickness of the document involved, a difficulty frequently attending the usage of a portable imprinter mechanism.

One of the major difficulties encountered in the use of imprinters, both portable and stationary, has been the tendency of the imprinter roller mechanism to lock into printing position with the result that the document or receipt is damaged or smudged on the return cycle of the roller. Prior art attempts to alleviate this difficulty have resulted in the development of extremely complex and costly mechanisms which have proved to be more costly to manufacture and maintain than the units they were intended to replace. The combination of increased costs and reduced service life has kept the imprinter financially out of the reach of many small merchants whose overhead is incapable of supporting such an item, and has likewise precluded the development of inexpensive portable imprinters for the aforementioned uses.

SUMMARY OF THE INVENTION

In accordance with the present invention, a portable imprinter is disclosed for transfering indicia from a printing place to a document such as a sales slip which comprises a generally rectangular container, said container comprising a base, the inner surface of which defines a printing bed for supporting the printing plate and receiving the document in position thereover, a frame attached to said base comprising paired longitudinal and lateral framed portions, a pair of opposed longitudinally extended slots provided at the abutment of said longitudinal frame portions, and said base for insertion of said printing plate and said document therein, and an imprinting roller assembly comprising a generally rectangular reciprocable carriage rollably mounted within said frame in cooperation with said longitudinal frame portions, a printing roller supported within a U-shaped bracket, said bracket pivotally retained within said carriage on the side of said carriage and juxtaposed to said base, and a rectangular cover mounted on said carriage on the side thereof opposite said bracket, wherein said bracket is under spring bias placing said roller in constant contact with said base. When not in use, the imprinter of the present invention is maintained whereby the roller is located on a starting platform attached to said base, which is slightly extended over and above said printing bed to permit the unrestricted insertion of the document or receipt to be imprinted. During the printing stroke, the roller descends from the starting platform into tensioned contact with the document to be printed. Tensioned contact is maintained by the rigid abutment of said bracket against said cover. As such rigid abutment is not occasioned on the return stroke, the roller is safely in contact with the document without causing either smudging or tearing thereof.

The U-shaped bracket supporting the roller of the present invention is pivotally retained within the carriage by a shaft passing therethrough, the ends of which are journalled within paired rollers communicating with tracks provided in said longitudinal frame portions enabling said carriage to reciprocate across said base. The spring bias is exerted on said bracket by a torsion spring having a fulcrum essentially mounted on the shaft, and respective arms urging against said bracket and said cover, whereby pressure is constantly maintained forcing said bracket against said cover, thus correspondingly pivoting said roller away therefrom.

The imprinter of the present invention is simple in design and operation and may be produced in a wide variety of inexpensive materials including various well-known thermoplastic and thermosetting resins and the like. Further, the unique design of the container enclosure ensures that the imprinter mechanism is well protected from damage arising from exposure to environmental elements and the like, with the result that the useful life of the mechanism is extended and the incidence of its repair is reduced significantly. Further, the provision of the opposed slots for the insertion of the document and the printing plate greatly simplifies the use of the imprinter, as transactions are rapidly and effectively recorded.

Though primarily directed to the preparation of portable imprinters, the present invention is equally applicable to the preparation of larger stationary imprinters, as its reduced cost and simplicity of design and operation are equally desirable in such applications.

Accordingly, it is a principal object of the present invention to provide a portable imprinter possessing simplicity of design and operation at a reduced cost.

It is a further object of the present invention to provide an imprinter as aforesaid wherein spring bias tension is employed to maintain the roller in constant contact with the surface of the document to be imprinted.

It is yet a further object of the present invention to provide an imprinter as aforesaid which is of such design that exposure of the mechanism to contaminants is greatly reduced.

It is yet a further object of the present invention to provide an imprinter as aforesaid which may be manufactured in a wide variety of sizes from a wide variety of materials.

Other objects and advantages will become apparent to those skilled in the art from a consideration of the description which proceeds with reference to the following drawings.

DETAILED DESCRIPTION OF THE INVENTION

Figure 1:
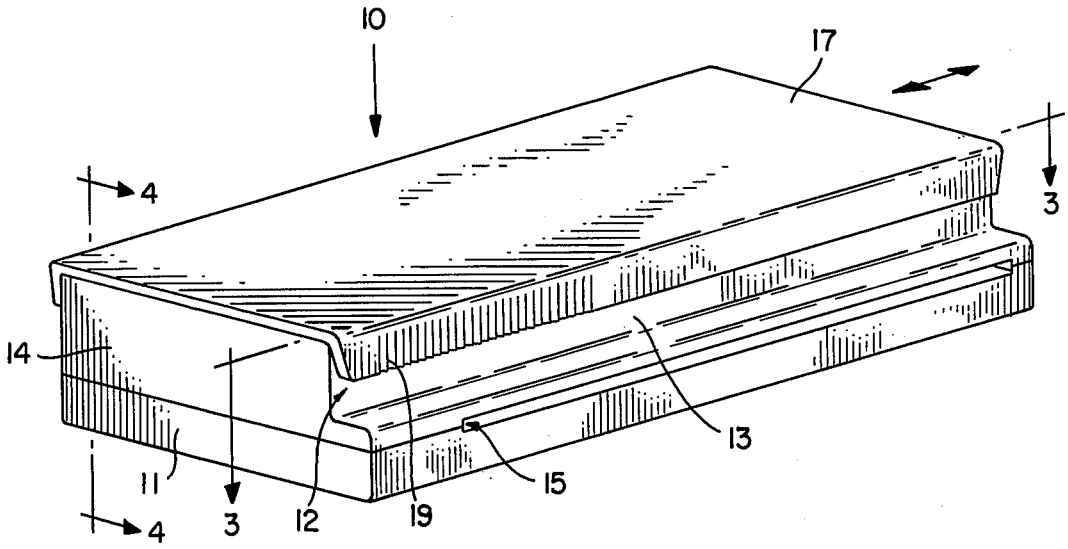
FIG. 1 is a perspective view of an assembled portable imprinter in accordance with the present invention.

Referring now to the drawings where like numerals designate like parts and wherein FIG. 1 comprises a perspective view of an assembled imprinter designated 10, imprinter 10 is superficially seen to comprise three basic components, the first being base 11 which defines the printing bed (not shown in this figure) which supports the printing plate and the document during the printing process. As is suggested by the figures generally, base 11 is of rectangular shape, through the invention is intended by its scope to encompass a wide variety of shapes not inconsistent therewith.

Figure 2:
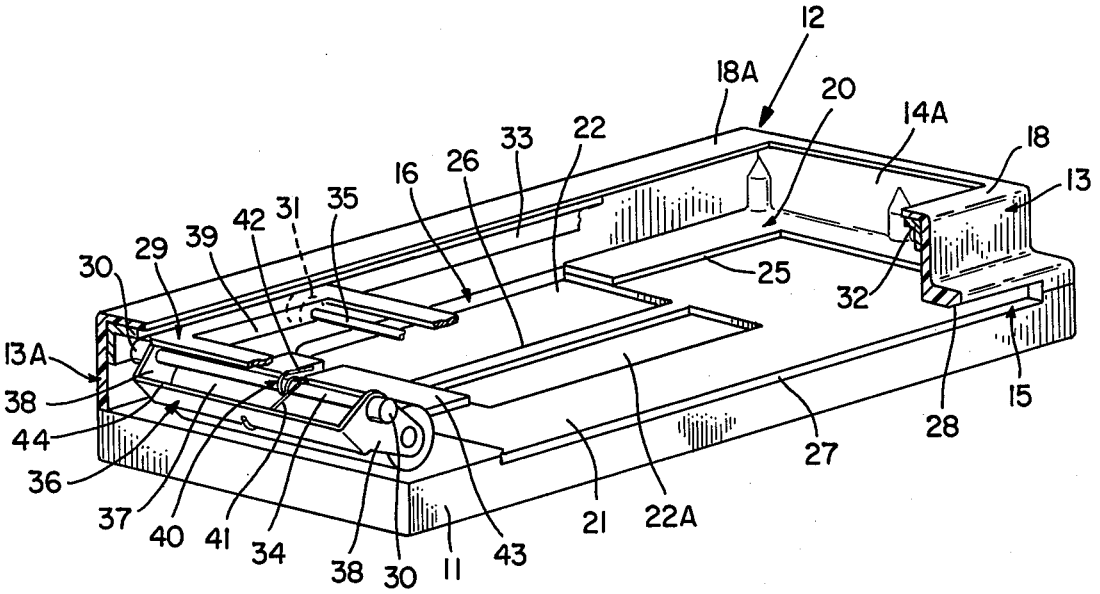
FIG. 2 is a sectional perspective view of the imprinter of FIG. 1 partly broken away and with the cover removed to illustrate the interior thereof.

Referring further to FIG. 1, the second component, comprising frame 12 is shown as mounted on top of base 11 to provide the walls of the container-like structure of imprinter 10. Frame 12 is illustrated as an integral structure, however it is contemplated within the scope of the invention that frame 12 may include a plurality of mating portions. Thus, longitudinal frame portions 13 and lateral frame portions 14 might be separately produced and subsequently assembled. Longitudinal frame portion 13 as shown in FIG. 1 is notched to define, in conjunction with base 11, a longitudinally extended slot 15. Referring now to FIG. 2, opposed longitudinal portion 13A is seen to define a similar slot 16 opposite to slot 15, slot 16 is provided for the insertion of a credit card or the like, while the document or sales receipt may be inserted in slot 15.

Referring back to FIG. 1, imprinter 10 further comprises a rectangular leaf-shaped cover 17 disposed in moveable association over the open end of frame 12 specifically resting upon flat upper surfaces 18 and 18A defined by portions 13 and 13A, respectively, as shown and labeled in FIG. 2. Cover 17 is of such dimension that, when the imprinter is not in use, it completely shrouds the inner mechanism thereby preventing the entry of any contamination. Likewise, cover 17 is adapted to serve as a handle to promote the hand actuation of the imprinter roller assembly in a manner to be discussed later on. In this connection, the side surfaces of cover 17 may be roughened by the provision of parallel slots or the like defining handgrips 19 for facilitating the actuation of the roller assembly.

Figure 6:
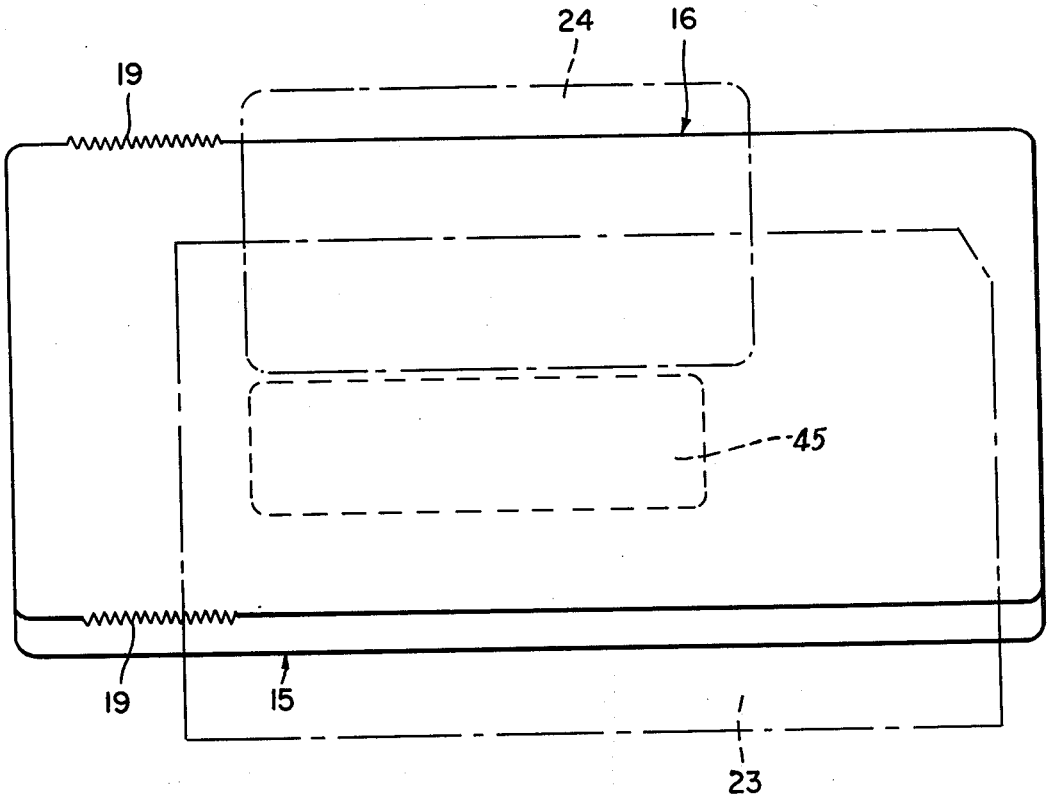
FIG. 6 is a schematic plan view partly in phantom illustrating the placement of a printing plate and a document in the imprinter of the present invention.

The mechanism of imprinter 10 is disclosed in greater detail in FIG. 2, comprising a sectioned perspective view wherein cover 17 and portions of frame 12 have been removed. Base 11 is seen to comprise on its upper surface a printing bed 20 provided with a primary recess 21 for the support of the document or sales slip, and a secondary recess 22 of the depth greater than primary recess 21 enabling the insertion of a credit card or the like, not shown, whereby said document resides in this position over the credit card. As is apparent from FIGS. 2 and 6, insertion of a receipt through the slot 15 results in its displacement and support within recess 21, while similar insertion of a credit card or the like through slot 16 results in the disposition of the credit card in recess 22 below the receipt or document. In FIG. 6, comprising a schematic plan view partly in phantom, the disposition of a receipt 23 in relation to a credit card or the like 24 is depicted. Upon insertion of receipt 23 and credit card 24 into respective slots 15 and 16, alignment of each with the other is assured by the provision of stops comprising longitudinal borders 25 and 26 which define the periphery of recesses 21 and 22, respectively. Thus, both the credit card and the receipt may be inserted correctly by merely pressing them through the respective slots until engagement with the respective borders is achieved. In this connection, slots 15 and 16 are provided with beveled outer surfaces which further facilitate the introduction of the respective card or receipt. Referring to FIG. 2, slot 15 is seen to possess an outward bevel defined by lower beveled edge 27 present on base 11, and upper beveled edge 28 defined on frame portion 13. Likewise, though not illustrated therein, similar bevels are provided on base 11 and frame portion 13A in conjunction with slot 16.

Referring once again to FIGS. 2 and 6, imprinter 10 is further provided with a recess 22A, of a depth similar to secondary recess 22, for the provision of a name plate or the like identifying a commercial establishment employing the imprinter. Thus, in FIG. 6, name plate 45 may be positioned adjacent credit card 24 whereby the merchant's name will appear below the credit card holders name and number. Nameplate 45 may be fastened within recess 22A in a wide variety of ways, and the invention should not be construed as limited to any particular method of installation.

Referring further to FIG. 2, the imprinting roller assembly of the present invention is depicted in broken perspective, and comprises generally rectangular carriage 29 which is retained within frame 12 by contact with longitudinal portions 13 and 13A. Carriage 29 is adapted for reciprocal movement along portions 13 and 13A with provision of roller pairs 30 and 31 within the channels 32 and 33, respectively, provided in portions 13 and 13A as further illustrated in FIGS. 3 and 4. Roller pair 30 is connected by primary shaft 34 while roller pair 31 is connected by secondary shaft 35. Primary shaft 34 serves to support U-shaped bracket 36 in position adjacent to carriage 29, and is accordingly, journaled therethrough. The interrelationship of carriage 29, first roller pair 30, primary shaft 34 and bracket 36 is further illustrated in FIG. 4, comprising a sectional view taken through line 4—4 of FIG. 1. It is thereby apparent that primary shaft 34 provides the axis of rotation for bracket 36 which supports roller 37 in position in contact with bed 20.

Figure 3:
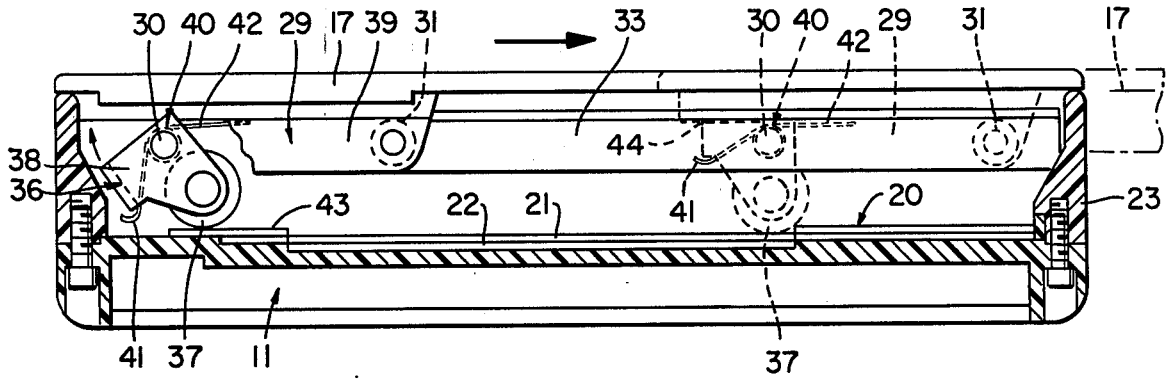
FIG. 3 is a side sectional view partly in phantom taken through line 3—3 of FIG. 1.
Figure 4:
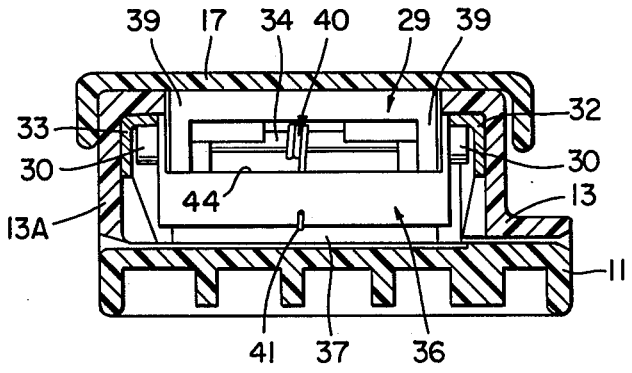
FIG. 4 is a sectional view of the imprinter of FIG. 1 taken through lines 4—4.

Referring now to FIGS. 2, 3 and 4, bracket 36 is adapted to pivot in relation to carriage 29 about shaft 34, whereby roller 37 may be brought into contact with bed 20. Roller 37 is journaled between arms 38 extending from bracket 36 and is supported thereon by an axle (not shown). Arms 38 are configured to accept primary shaft 34 which is journaled therein as shown. In turn, bracket 36 is retained by carriage 29 through the acceptance of shaft 34 by downwardly extending yoke portions 39.

The imprinting roller assembly may be constructed from a wide variety of materials. Particularly, certain of the elements including bracket 36, shafts 34 and 35, paired rollers 30 and 31, tracks 32 and 33, and the axle-supporting roller 37 (not shown) are preferably constructed from a lightweight metal of appropriately reduced gauge, whereas roller 37 is preferably formed from an elastomeric material, such as plastic, rubber or the like. As noted earlier, the remainder of the assembly comprising imprinter 10 may be prepared from a wide variety of materials including various thermoplastic and thermosetting resins, metals and the like. Naturally, as such diverse materials may be employed in the manufacture of the imprinter of the present invention, the choice of a particular material with the above qualifications is not believed critical, and the invention should accordingly not be limited thereby.

In accordance with the present invention, roller 37 is maintained in constant contact with base 11 and, particularly, with bed 20 by the provision of spring bias tension placed upon bracket 36. Particularly, spring bias tension is provided through coiled torsion spring 40 located with its fulcrum surrounding shaft 34 in the manner best illustrated in FIGS. 2 and 4. Spring 40 possesses arms 41 and 42 which, respectively, bear against bracket 36 and cover 17, whereby bracket 36 is under constant tension to pivot in the direction of cover 17. As will be explained hereinafter, this results in the placement of roller 37 under the required printing tension.

The operation of imprinter 10 is best illustrated with reference to FIG. 3. Before the commencement of printing, roller 37 must be located out of contact with both recesses 21 and 22 to enable the insertion of the receipt and the credit card. This is accomplished by the reciprocation of carriage 29 to the positions shown in solid lines in FIG. 3, whereby roller 37 is retained on the left-hand side of the figure in solid lines on starting platform 43 which is provided on bed 20. Platform 43 comprises a planar member extending over a portion of recess 21 in elevation thereto. Platform 43 does not extend into recess 21, and thus a receipt may be inserted therein without encountering obstruction from platform 43.

Insertion of the credit card and the receipt is best accomplished sequentially, whereby the credit card is first inserted in slot 16, followed by the insertion of the receipt in slot 15. As noted earlier, full insertion of both credit card and receipt will resemble the schematic representation of FIG. 6.

Figure 5:
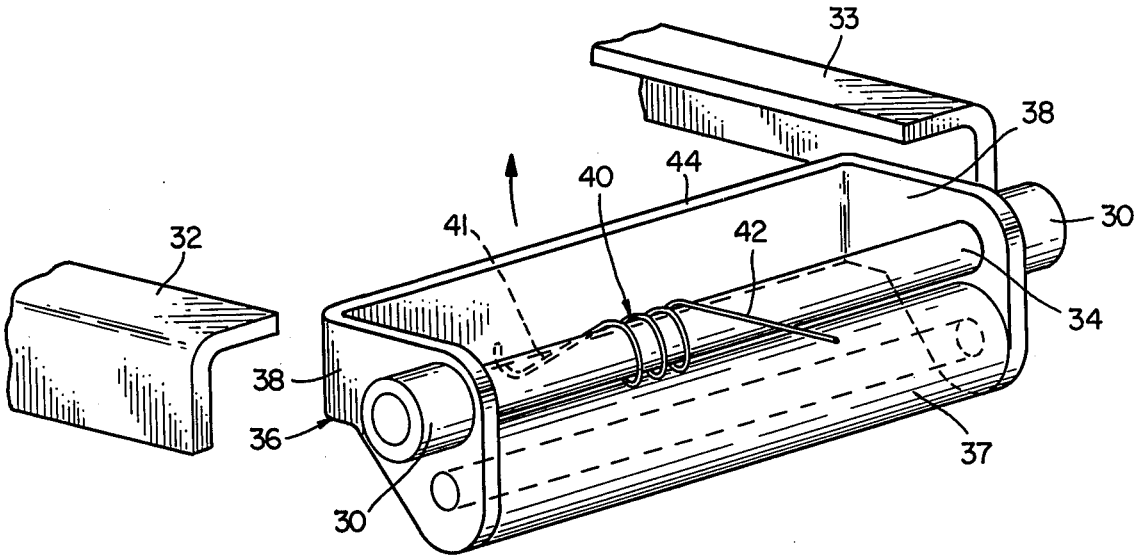
FIG. 5 is a schematic perspective view illustrating a portion of the roller assembly of the present invention.

After insertion of the credit card and the receipt, printing is conducted by the longitudinal movement of the carriage 29 in the direction shown by the dark arrow in FIG. 3, whereby roller 37 drops off platform 43 and into contact with the receipt residing within recess 21. During the printing stroke, as illustrated in phantom on the right-hand portion of FIG. 3, the biasing tension exerted by torsion spring 40 against bracket 36 forces bracket 36 into contact with cover 17 while at the same time forcing roller 37 into firm printing engagement. During the printing stroke, bracket 36 is retained in rigid abutment against cover 17 as shown which serves to provide the additional printing tension required for roller 37 to effectively imprint the receipt. Referring also to FIGS. 2 and 5, rigid abutment between bracket 36 and cover 17 is gained through the contact with said cover of edge 44 of the bracket. Edge 44 effectively operates as a stop which prevents the continued pivoting motion of bracket 36 in response to the printing motion and the action of spring 40.

Though not wishing to be bound to any particular theory of operation, Applicant believes that the angle of displacement of bracket 36 with respect to printing bed 20 is such that, during the printing cycle, the vector forces acting upon roller 37 are translated into additional biasing forces similar to those exerted by spring 40 which assist in firmly engaging edge 44 of bracket 36 in abutment with cover 17. The foregoing is believed to provide sufficient tension upon the receipt and printing medium by virtue of the full extension of roller 37 into contact therewith.

After printing is completed, carriage 29 is returned to the starting position by longitudinal movement from the position shown in phantom in FIG. 3 to that shown in solid lines. During this movement the forces acting upon roller 37 are such as to balance the tension imparted by spring 40 with a result that roller 37 is permitted to roll under reduced tension along the surface of the receipt. Bracket 36 is just pivoted away from contact with cover 17 and, as a structure similar to edge 44 is not present on the opposite end of bracket 36, the bracket is permitted to pivot freely toward cover 17 in the opposite direction whereby roller 37, as aforesaid, may roll under reduced tension across the receipt. Roller 37 thus maintains constant contact with the receipt and with printing bed 20, however, on the return stroke, the tension exerted through roller 37 is such that the receipt is undamaged after completion of the return stroke. Upon completion of the return of carriage 29, roller 37 is caused to rise up to reside on starting platform 43 and thus is removed from contact with the printed receipt. The receipt and the credit card may then be removed and a subsequent receipt and credit card inserted in respective slots.

It should be apparent from the previous discussion that the imprinter of the present invention is of simplified construction and operation. Printing may be quickly and effectively accomplished without tearing or otherwise mutilating the receipt or document. Printing quality remains uniform regardless of the thickness of either the document or the printing plate, as the rigid abutment of the bracket with the cover serves to compensate for variations in receipt thickness and height of of indicia on the printing plate.

As stated earlier, the imprinter of the present invention may be constructed in a minimum of a number of operations from a wide variety of inexpensive materials. Thus, in the illustration presented herein, the bulk of the imprinter is constructed from a resinous material which may be molded by a wide variety of well-known techniques such as stamping, injection molding and the like, with the result that the cost of production of the imprinter is drastically reduced. Further, the resiliency of such materials adds to the durability of the imprinter and effectively increases its useful life. Moreover, the reduction in costs of production of the imprinter enables its sale to merchants at a commercially attractive price which ensures its widespread use in commerce.

While the foregoing discussion has proceeded with reference to the accompanying figures, disclosing a particular imprinter apparatus, the invention should not be so limited and, further, is believed to encompass obvious variations of design. For example, the imprinter could be modified by the extension of slot 15 in FIGS.

1 - 3, 5 and 6 to the right within both frame portions 13 and 14. This modification would permit the employment of sales receipts of extended length such as are found in many retail establishments, without conferring any deleterious effect on the operation of the imprinter.

This invention may be embodied in other forms and is subject to variations in form, size, and arrangement of parts without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A portable imprinter for transferring indicia from a printing plate to a document such as a sales slip, comprising a generally rectangular container, said container comprising a base, the inner surface of which defines a printing bed for supporting the printing plate and receiving the document in appropriate position thereover, a frame attached to said base comprising paired longitudinal and lateral frame portions, a pair of opposed longitudinally extended slots located on opposite sides of the base and at the junction with the frame for insertion of said printing plate and said document, and a reciprocable imprinting roller assembly comprising a generally rectangular carriage rollably mounted within said longitudinal frame portions and adapted for longitudinal reciprocation therebetween, a generally U-shaped bracket supported by said carriage, said bracket defining a pair of parallel, generally triangularly shaped, spaced-apart arms, a laterally extending first shaft member journaled through said arms and passing through said carriage to provide a pivotal connection between said bracket and said carriage, a second shaft member parallel to said first shaft member journaled through said carriage, paired rollers located at the respective ends of said first and said second shaft members, said rollers extending laterally beyond said carriage and in rollable contact within said respective longitudinal frame portions, said paired rollers serving to support said carriage during rollable reciprocation therewithin, a printing roller rotatably mounted on an axle, said axle journaled through said arms and situated in spaced-apart relation to said first and said second shaft members, said roller adapted to make contact with said printing bed, spring biased tensioning means anularly displaced about said first shaft member, said tensioning means adapted to urge said roller away from said carriage and into constant tensioned abutment with said printing bed, and a rectangular cover mounted on said carriage on the side thereof opposite said bracket.

2. The imprinter of claim 1 wherein said longitudinal frame portions define longitudinally extended notches on the edges thereof abutting said base, said notches cooperating with corresponding recesses provided in said base to define said slots.

3. The imprinter of claim 1 wherein said printing bed comprises a primary recess adapted for the insertion of said document, and a secondary recess of a depth greater than said primary recess adapted to receive said printing plate located beneath said document.

4. The imprinter of claim 1 wherein said printing bed further includes a stationary planar platform member extending over and above a portion of said primary recess, said platform adapted to hold the printing roller out of contact with the receipt when not in use.

5. The imprinter of claim 4 wherein said tensioning means comprises a torsion spring comprising a central cylindrical coiled section defining an arm at each of the opposite ends thereof, each of said arms extending radially therefrom in a plane perpendicular to the axis of said coiled section, said torsion spring mounted upon said first shaft member whereby one of said arms urges against said cover and the other of said arms urges against said bracket to place said roller in said tensioned abutment with said printing bed.

6. The imprinter of claim 1 wherein said carriage is adapted for reciprocation by the provision of paired rollers mounted on shafts extending in directions transverse to the line of movement of said carriage and within longitudinally extended tracks provided within opposed longitudinal frame portions.

7. The imprinter of claim 6 wherein one of said shafts comprises said first shaft member.

8. The imprinter of claim 1 wherein said cover includes parallel, perpendicularly extending side surfaces located along the longitudinal dimensions thereof, said side surfaces providing a hand gripping means for actuating said roller assembly.

9. The imprinter of claim 8 wherein said side surfaces possess parallel slots over at least a portion thereof to aid in gripping said cover.

* * * * *